United States Patent [19]

Fergusson et al.

[11] Patent Number: 4,766,312

[45] Date of Patent: Aug. 23, 1988

[54] METHODS AND APPARATUS FOR DETECTING NEGATIVE IONS FROM A MASS SPECTROMETER

[75] Inventors: Gordon J. Fergusson, Claremont, Calif.; Marvin L. Vestal, Houston, Tex.

[73] Assignee: Vestec Corporation, Houston, Tex.

[21] Appl. No.: 49,928

[22] Filed: May 15, 1987

[51] Int. Cl.[4] ..... H01J 49/02

[52] U.S. Cl. ..... 250/281; 250/283; 250/292; 250/299; 313/103 R

[58] Field of Search ..... 250/281, 292, 299, 283; 313/103 R; 328/227; 324/71.3

[56] References Cited

U.S. PATENT DOCUMENTS

| | | | |
|---|---|---|---|
| 3,997,298 | 12/1976 | McLafferty et al. | 23/253 R |
| 4,008,388 | 2/1977 | McLafferty et al. | 235/151.35 |
| 4,066,894 | 1/1978 | Hunt et al. | 250/292 |
| 4,423,324 | 12/1983 | Stafford | 250/281 |
| 4,536,652 | 8/1985 | Cooks et al. | 250/281 |

*Primary Examiner*—Bruce C. Anderson

*Assistant Examiner*—Jack I. Berman

*Attorney, Agent, or Firm*—Browning, Bushman, Zamecki & Anderson

[57] ABSTRACT

Improved methods and apparatus are disclosed for detecting negative ions and, more particularly, for detecting negative ions produced from a quadrupole mass spectrometer. By modulating the ion beam either at the ion source or within the ion focusing system, the output current from the electron multiplier detector is a pulsating current which is then capacitively or inductively coupled from a high direct current potential to ground level. Electronics operating at ground level are employed to correct the current signal distortion due to the capacitive or inductive coupling of the detector output current. The present invention enables substantially increased detector sensitivity to negative ions compared to prior art equipment, and does not require expensive and complex preamplifier circuitry. The techniques of the present invention allow both positive and negative ions to be detected utilizing the same basic equipment, thereby increasing equipment versatility and reducing costs.

20 Claims, 5 Drawing Sheets

METHODS AND APPARATUS FOR DETECTING NEGATIVE IONS FROM A MASS SPECTROMETER

FIELD OF THE INVENTION

The concepts of the present invention relate to methods and apparatus for detecting negative ions produced by a mass spectrometer and, more particularly, to techniques for detecting negative ions wherein the cathode of the electron multiplier is maintained at a high positive voltage and the anode is maintained at a higher positive voltage.

BACKGROUND OF THE INVENTION

There is an increasing use of mass spectrometers for obtaining both qualitative and quantitative information, such as molecular weight, isotope ratios, and elucidation of structure, from a given sample. Recent developments in mass spectrometry ionization techniques enable the efficient producticn of both positive and negative ions. More useful analytical information can be obtained from detecting both the positive and negative ions produced by such techniques than that obtained when only positive ions are detected.

Conventional technology for detecting positive ions utilizes a dynode electron multiplier having a negatively charged cathode and its anode at ground potential. This technique offers substantial advantages of positive ion detector system simplicity, since the detector signal is generated at ground potential and thus can be easily massaged by conventional circuitry. The sensitivity of this prior art positive ion detector is, however, limited, and more refined mass spectrometry analysis could be obtained if the positive ion detector system sensitivity were increased.

Prior art techniques for detecting negative ions present complex problems not encountered with positive ion detectors. A standard negative ion detector technique places the cathode of the electron multiplier at a high positive voltage, e.g., +1.5kV to +2.5kV, while the anode is placed at a still higher positive voltage, e.g., +3kV to +5kV. This technique obtains satisfactory detection sensitivity, but has a significant disadvantage since the signal is obtained at a high positive voltage rather than at ground level. Accordingly, this system requires complete electronic circuitry operating at the high positive voltage for amplilfying the detected signal and converting that signal to a representative signal at ground potential. In additional to the substantial expense of this high voltage electronic circuitry, this prior art system can be sensitive to background and microphonic noise.

Another technique for detecting negative ions is disclosed in U.S. Pat. No. 4,423,324. This technique utilizes a conversion dynode which functions as an ion reflector and converts the incoming negative ions to positive ions, which are then directed to an electron multiplier with its output at ground potential for detection. Since the detected signal is at ground potential, complex preamplification circuitry is not required. Losses at the conversion dynode are, however, significant, and accordingly this technique offers reduced ion detection efficiency. Although the conversion efficiency should increase as the detected mass units increase, the actual conversion efficiency for a mass range below 500 may be only a few percent.

The disadvantages of the prior art are overcome by the present invention, and improved methods and apparatus are hereinafter disclosed for detecting negative ions. More particularly, the concepts of the present invention allow for high sensitivity detection of negative ions from a quadrupole mass spectrometer without utilizing complex circuits for dealing with high voltage signals from the detector.

SUMMARY OF THE INVENTION

The concept of the present invention may be used for providing an improved negative ion detector for use in conjunction with a quadrupole mass spectromenter. The ion beam to the mass spectrometer is modulated to provide an output current from the detector which is capacitively or inductively coupled from a high positive potential to ground potential. Electronic circuitry at ground potential is then utilized to correct for signal distortion introduced by the capacitive or inductive coupling. Although either capacitive or inductive coupling may be employed to couple the pulsating signal to ground potential, capacitive coupling is preferred and will be the embodiment more particularly described below. The concepts of the present invention may be employed to obtain high sensitivity detection of negative ions without the need for electronics operating at high potentials relative to ground.

The principles of the present invention may be used for mass spectrometry analysis when either scanning over a wide range of mass units (scanning mode of operation), or when analyzing a specific mass unit (specific ion monitoring or SIM). During the scanning mode of operation, modulation of the ion beam may not be necessary at high scanning rates, e.g., above 200 mass units per second, since the signal generated by each specific mass unit will be obtained over a relatively short time and will thus appear to be a pulsating signal to the capacitors coupled to ground. In either case, signal correction is provided to compensate for distortion due to the charging of the capacitor that occurs during the pulse and subsequent partial discharge when no pulse signal is present.

According to the present invention, the time constant for the correction signal decay is preferably less that the time constant for the pulse signal decay thereby eliminating overcorrection and false output signals. Maintaining the correction signal decay approximately equal to or only slightly less than the pulse signal decay reduces fractional signal loss and thus improves detector sensitivity. The undesireable effects of DC output drift are substantially reduced or eliminated by offsetting the output from the current to voltage converter to be slightly positive. The detector circuit may include an adjustable compensation controller for fixing the output voltage for varying positive input currents due to discharge of the coupling capacitor. An adjustable zero controller is also provided for correcting residual offset voltages and returning the output voltage to zero.

Although particularly suitable for detecting negative ions, the concepts of the present invention may also be utilized for obtaining an improved sensitivity positive ion detection. Also, the techniques of the present invention may be employed with a conversion dynode to further increase detectcr sensitivity.

These and further features and advantages of the present invention will become apparent from the following detailed description wherein reference is made to the figures in the accompanying drawings.

DETAILED DESCRIPTION OF PREFERRED EMBODIMENTS

The present invention may be utilized for detecting negative ions with the anode of the electron multiplier at a high positive potential. Although the detection of negative ions according to this basic concept is not novel, problems associated with the high potential output signals have been noted earlier. Recent technology, such as that disclosed is U.S. Pat. No. 4,423,324, moves away from the concept of utilizing a high positive potential at the anode of electron multiplier to detect negative ions due to the disadvantages. Thus the present invention returns to the concept of maintaining the anode of electron multiplier at a high positive potential when detecting negative ions, but additionally solves the significant problems of the prior art associated with the detected signal being at a high voltage.

Figure 1:
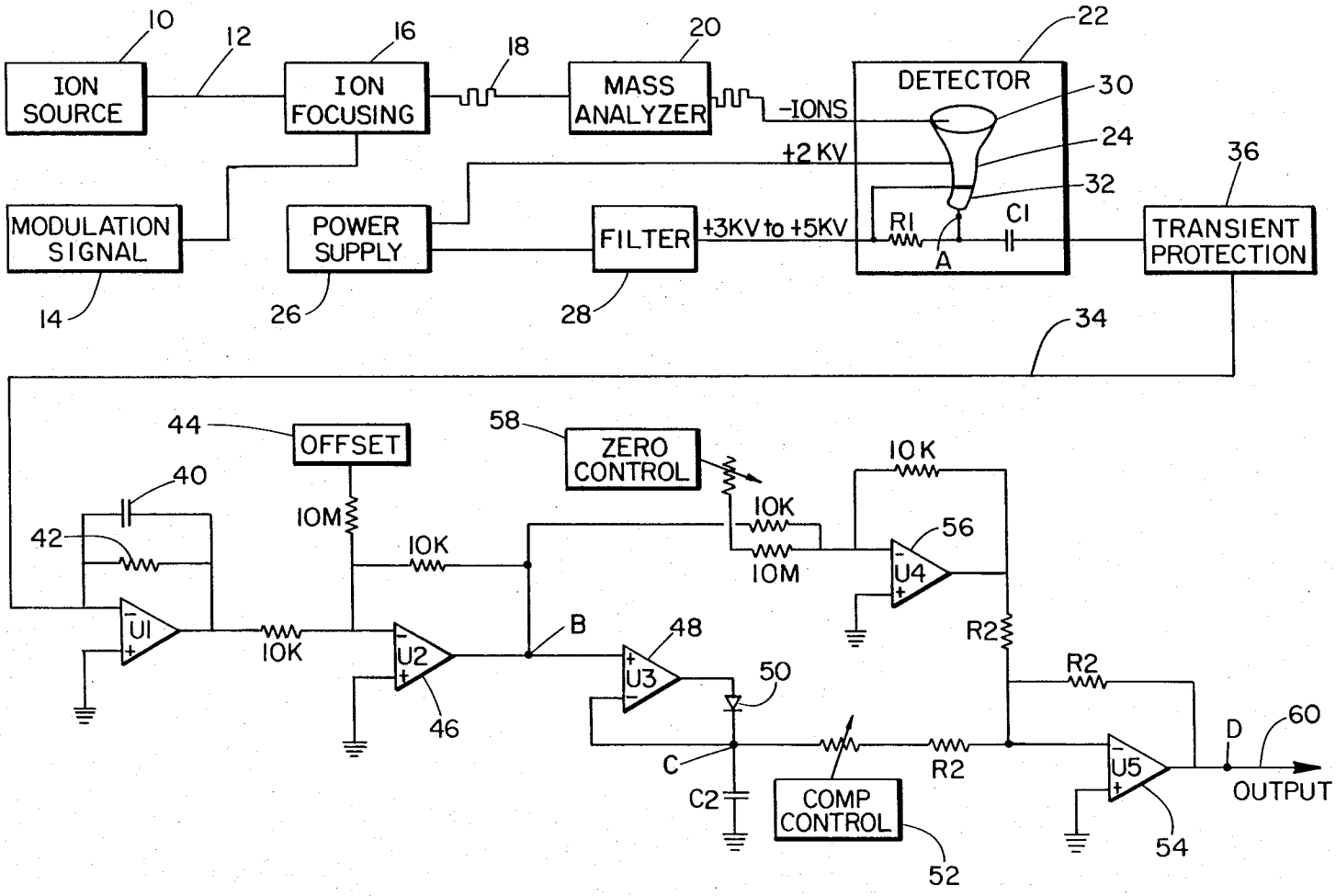
FIG. 1 is a block diagram of a mass spectrometer according to the present invention including a modulated ion beam to the mass analyzer and circuitry for correcting the detected output distortion due to capacitive coupling.

Referring to FIG. 1, the ion detector of the present invention is ideally suited for mass spectrometry use, wherein ion source 10 provides an ion beam 12 having ions characteristic of the sample molecules. The ion beam 12 is input to a conventional ion focusing unit, which may comprise a series of electrostatic lenses of a type well known in the art. The ions are then input to mass analyzer 20, which may be a quadrupole mass analyzer capable of scanning over a range of atomic mass units. Detector 22 is positioned at the output of mass analyzer 20, and may be used to produce a representation of the mass spectrum for identifying the sample. The electron multiplier 24 of the detector 22 has its cathode 30 at a high positive potential, e.g., +2kV, and its anode 32 at a higher positive potential of from +3kV to +5kV. Accordingly, a conventional power supply 26 and filter 28 are provided for maintaining the electron multiplier 24 a its desired potential.

The present invention requires a rapidly fluctuating output from the detector, which then can be capacitively coupled from a high voltage potential to ground. Assuming that the scanning rate of the analyzer 20 is relatively slow, e.g., below 200 mass units per second, or that the mass analyzer is employing a specific ion monitoring technique, modulation of the ion beam is required. This modulation is possible either by regulating the ion source 10 or the ion focusing unit 16. As shown in FIG. 1, an on/off modulator unit 14 can be provided for generating a timed gating signal and thereby generating a square wave ion beam 18 input to the mass analyzer 20.

Referring now to FIGS. 1 and 2, the ion detector and circuitry of the present invention may be understood by considering signals from the detector 22 at various stages in the circuitry when the mass analyzer 20 as shown in FIG. 1 is operating in the slow scanning rate mode.

Figure 2A:
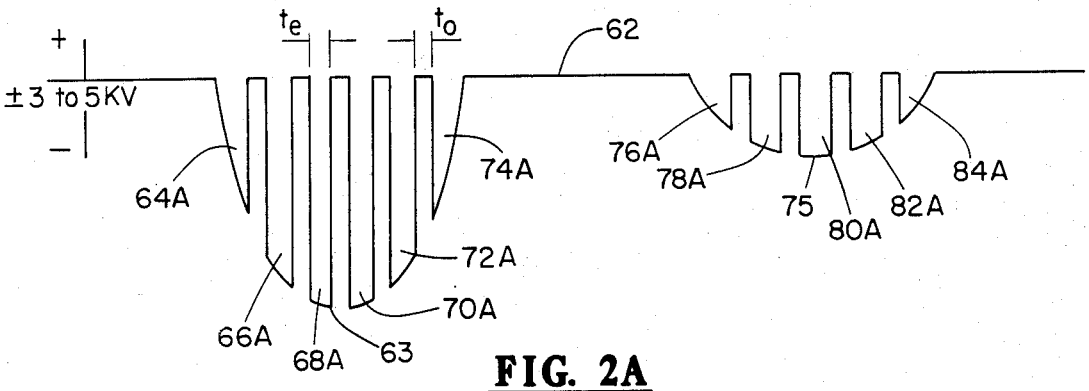
FIGS. 2A-2D illustrate representative signals from the electron multiplier shown in FIG. 1 at various stages in the circuitry and with the mass analyzer operating in scanning mode.

The current output from the electron multiplier 24 will be modulated in accordance with the modulated flow of negative ions to the detector. The output from the electron multiplier at point A in the circuit is thus shown in FIG. 2A, with the modulated square wave signal being energized for time $t_e$ then off for time $t_o$. FIG. 2A shows a large peak signal 63 from the detector 24 followed by a small peak signal 75, each being indicative of detected negative ions and representative of spectrum mass units for the sample. As previously explained, a significant problem is that each of these signals 63, 75 is at a generally high positive potential of, for example, 3kV to 5kV, and expensive circuitry was heretofore required to accomodate such high, potential signals from mass spectrometry detectors.

Figure 2B:
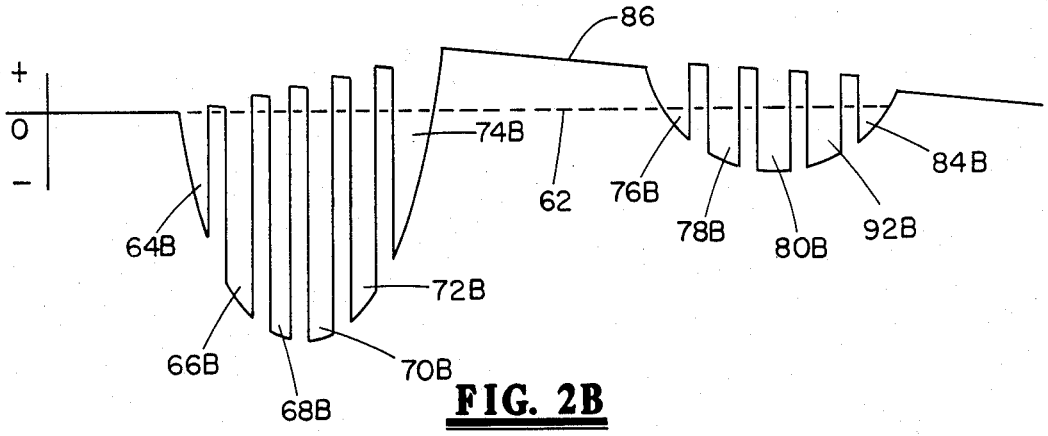

To obviate this problem, Applicant teaches passing the detected signals through capacitor C1, and subsequently to a current to voltage amplifier, U1. Current flow through C1 and thus the current flow and voltage at point B within the circuitry is shown in FIG. 2B. Each of the essentially square wave signals 64A, 66A, 68A, 70A, 72A, and 74A will continue through the circuitry, although the base line for the signals will shift as shown in FIG. 2B due to the charging and discharging of capacitor C1. Similarly, the square wave component 76A, 7BA, 80A, 82A, and 84A of the small peak signal 75 will continue through the circuitry, although less of a base line shift will occur due to the charging and discharging of capacitor C1 because of the comparatively smaller size of signal 75.

Figure 2C:
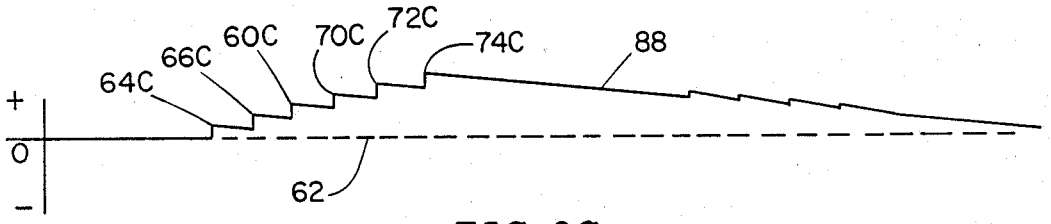
Figure 2D:
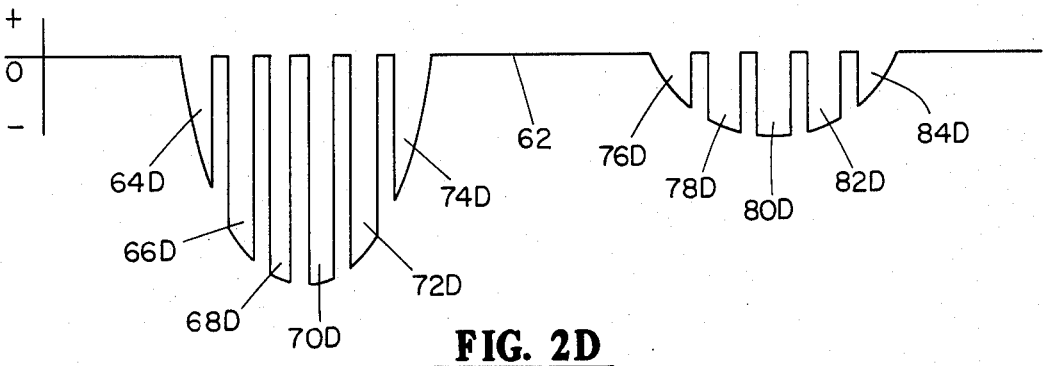

Referring to FIG. 2B, it should be understood that if only negative current flow was measured, a small peak following a large peak could be completely lost since the positive current flow following the large peak could be greater than the negative current flow from the small peak. Accordingly Applicant uses a peak detector U3 to produce a correction signal, as shown in FIG. 2C, which responds only to the peak positive voltage at point B in the circuitry. As explained subsequently, this correction voltage has a decay time constant R2C2 which should be equal to or less than the time constant R1C1. The circuit then effectively subtracts this correction voltage at point $C_c$ from the signal at point B to produce the signal as shown in FIG. 2D. Thus it should be understood that the output 60 from the detector as shown in FIG. 2D is a replica of the current flow from the electron multiplier, and that each of the square wave signals 64D–84D thus corresponds to the corresponding square wave signal 64A–84A. The significant difference, however, is that the signal as shown in FIG. 2D is a signal at nominal voltage relative to ground, while the signal shown in FIG. 2A is at an extremely high potential voltage relative to ground.

Since the function of the circuitry shown in FIG. 1 has been explained, more specific details of the circuit can be easily understood. The detected current passing through C1 is connected by 34 to a conventional transient protection circuit 36. Amplifier U1 in conjunction with capacitor 40 and resistor 42 serve to alter this current signal to a voltage signal. The output is then inverted by U2, resulting in a voltage signal representative of the current flow through the electron multiplier as altered by the charging effect of capacitor C1. For reasons noted below, the output from U2 is preferably offset to be slightly positive, resulting in the peak detector U3 being in continuous operation. Accordingly, a selected electrical bias of, for example, 15 millivolts is provided by effect 44.

The output from peak detector 48 passes through diode 50, and then charges capacitor C2. Adjustable compensation control 52 enables the output voltage 60 to be constant for a positive input current variation, e.g., from 0 to +2 microamps DC. Adjustable zero controller 58 allows for correction of any residual offset voltage of the operational amplifiers, and brings the baseline output voltage to zero. The current signal from the electron multiplier is thus combined with the zero output control signal, then inverted to a voltage signal by U4. Final correction of the capacitively affected signal from the detector at point B is thus made by U5 in response to the detected correction voltage at C. Accordingly, the signal output at D is virtually identical to the signal output at A.

Figure 3A:
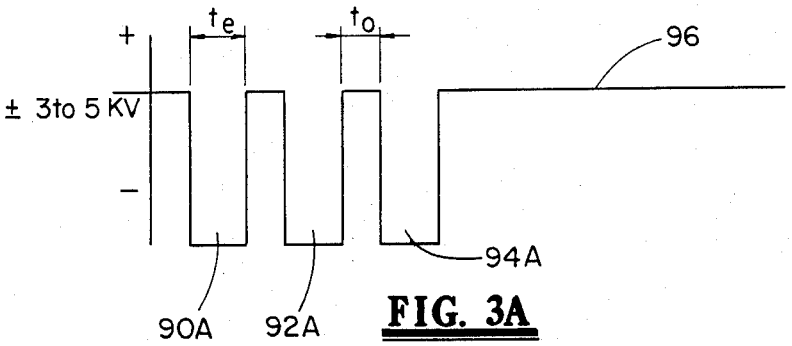
FIGS. 3A-3D illustrate representative signals from the electron multiplier shown in FIG. 1 at various stages in the circuitry and with the mass analyzer operating in the specific ion monitoring mode.

As previously noted, the concepts of the present invention may be used both for a continuous mass scanning operation for scanning 1,000 mass units or more, or may be used for specific ion monitoring (SIM) when only one mass is of interest and increased mass spectrometry sensitivity is desired. Representative output signals at points A, B, C, and D in the circuit depicted in FIG. 1 when the analyzer is operating in the SIM mode are shown in FIG. 3. In this mode, equilibrium in the current flow through R1 and C1 can be assumed since the time spent measuring a specific ion is markedly greater than the modulated beam on time, $t_e$. FIG. 3A shows the current flow from the electron multiplier at point in the circuitry, while 3B shows the current through capacitor C1 due to the charging and discharging of the capacitor C1 and, correspondingly, the voltage at point B. A correction signal is shown in FIG. 3C, which is then subtracted from the signal shown in 3B to produce the output signal shown in FIG. 3D. Again, the output signal is a close replica of the current flow from the electron multiplier.

Figure 3B:
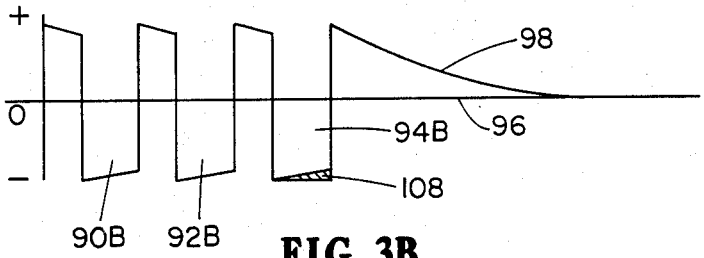
Figure 3C:
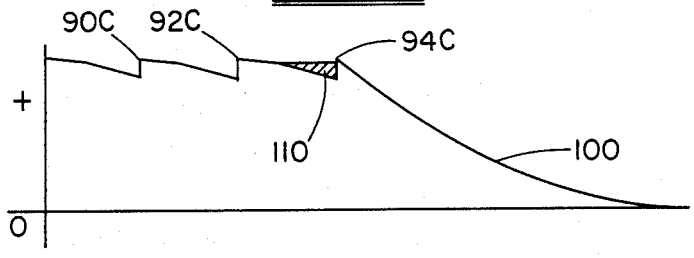

Referring to FIGS. 2B, 2C, 3B, and 3C, the decay of R1C1 with respect to the respective baseline 62, 96 is shown by lines 86, 98, respectively. Similarly, the decay of R2C2 with respect to the baselines is shown by the line 88, 100, respectively. Referring now to FIGS. 3B and 3C, if R2C2 were greater than R1C1, the downward slope of line 98 would be sharper than the downward slope of lOO, so that when the correction signal shown in 3C were subtracted from the signal shown in 3B, a false signal due to over-correction of the base line would occur. The output signal 60 would thus incorrectly represent the measurement of negative ions by the detector 22 subsequent to the measurement of any large signal from the detector. If, however, R2C2 is less that R1C1, the slope of 88, 100 will be responsive to R1C1, so that the signal decay shown in 2B will be identical to the signal decay in 2C, and correspondingly the signal decay 98 in 3B will be identical to the decay 100 in 3C, and no false output signal will occur.

The benefit of maintaining R2C2 only slightly less that R1C1 relates to the sensitivity of the correction signal, as shown in FIG. 3C. For example, the decay between peak correction signals 90C and 92C will be the combination of the R1C1 decay for the time $t_o$, plus the R2C2 decay for the time $t_e$. The difference between the R2C2 decay and the R1C1 decay will thus effect the sensitivity of the resulting output signal. In other words, signal component 92D will decay slightly faster than signal component 92B if R2C2 is much less than R1C1. Note that in FIG. 3C, the decay of the peak signal during time $t_o$ is slightly greater than the decay during time $t_e$. Since this correction signal decay can, however, easily be maintained only slightly less than the pulse signal decay, this difference results in an insignificant variance in the accuracy of the output signal. Equally important, this inaccuracy only slightly affects real ion peaks, rather than resulting in a false ion peak reading.

Figure 3D:
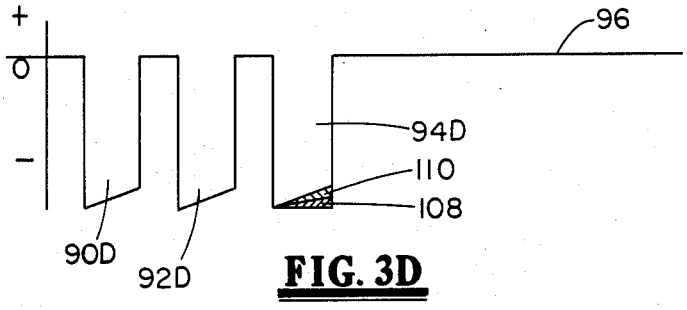

FIGS. 3B, 3C, and 3D depict graphically the relationship between actual signal loss and the time constants R1C1 and R2C2. The decay of the pulse signal due to the charging of the capacitor C1 is shown in FIG. 3B. During the pulse, the signal will decay due to capacitor charging at the rate shown in Equation 1, where $V_i$ is the input signal voltage to the capacitor, $t_e$ is the beam energized or beam on time, and R1C1 is the input coupling time constant.

$$\text{Pulse Signal Decay} = V_i e^{-\frac{t_e}{R1C1}} \qquad \text{Equation 1}$$

For the SIM or slow scanning modes, $t_e$ is substantially less than R1C1, and accordingly the integrated loss of signal intensity can be approximated by Equation 2.

$$\text{Loss of Signal Intensity} \simeq \frac{V_i t_e}{2R1C1} \qquad \text{Equation 2}$$

This integrated loss of signal intensity for the signal component 94B is thus graphically depicted in FIG. 3B by the area 108.

Similarly, the integrated loss of signal intensity due to the correction voltage decay is given in Equation 3, where $V_c$ is the input signal voltage to capacitor C2.

$$\text{Loss of Signal Intensity} \simeq \frac{V_c t_e}{2R2C2} \qquad \text{Equation 3}$$

The integrated loss of signal intensity due to correction voltage decay is graphically shown in FIG. 3C by the area 110. Since R2C2 may be assumed to be approximately equal to R1C1, the approximate total signal loss is given in Equation 4 and is graphically shown in FIG. 3D.

$$\text{Total Signal Loss} \simeq \frac{(V_i + V_c)t_e}{2R1C1} \qquad \text{Equation 4}$$

By comparing signal 94A and 94D, it can be seen that the loss in signal intensity can easily be maintained at less than a 5% signal loss, and preferably less than a 2% signal loss.

Figure 3E:
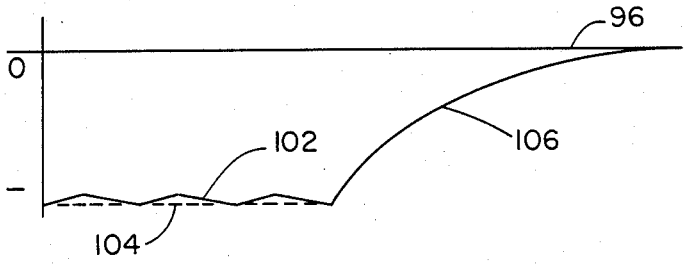
FIG. 3E illustrates the current through resistor R1 shown in FIG. 1.

The duty cycle and frequency of the modulation signal can, of course be varied for different applications. 2 and 3 show a typical duty cycle of beam on time te at approximately 67%, and a beam off time $t_o$ at approximately 33% of the cycle time. For linear operation in the SIM mode, the recommended maximum current from the electron multiplier (as shown in FIG. 3A) is 3 microamps. The average current 104 through R1 for the above-described duty cycle is 2 microamps, as shown in FIG. 3E, based upon the instantaneous current for successive beam on/beam off times prior to total decay 106 after the last beam on cycle. It is generally recommended that the collector potential change due to current flow through load resistor R1 not exceed 10 to 15 volts for the SIM mode, and this determines the maximum value of R1 for the above embodiment at 5 megohms. Assuming this 5 megohms value of R1, the minimum value for C1 is 400 picofarads if $t_e$ is 200 microseconds and a 5% signal loss is acceptable. For a wide range of applications, typical design values are 4.7 megohms for R1 and 470 picofarads for C1, resulting is a time constant R1C1 or 2.2 milliseconds. For a typical $t_e$ time of 200 microseconds, this R1C1 decay allows the fractional signal loss to be easily maintained at less than about 5%.

Figure 4:
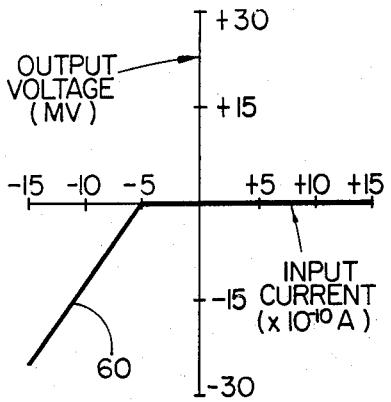
FIG. 4 illustrates graphically the desired constant voltage detector output for small steady state detector input variations when the output from the current to voltage converter is biased slightly positive.

FIG. 4 illustrates graphically the desired output voltage 60 of the circuit as shown in FIG. 1 for small steady state DC input signals. DC stability of the output signal 60 is important for achieving a maximum dynamic range of pulsating input signals. Undesirable currents to amplifier U1 can arise, however, due to the bias current of U1, circuit board leakage resistance, and/or leakage current through C1. If an JFET operational amplifier, e.g., TL071 is used for U1, a typical input bias current at 25° C. is $3\times10^{-11}$ amps and doubles for every 10° C. rise in temperature. Thus, these undesirable, temperature sensitive currents can flow to the input. of Ul, causing the output of U1 to change by several millivollts over time with anticipated temperature changes.

The undesirable effects of these DC currernts on U1 can be effectively eliminated, however, without affecting the sensitivity of the modulated output signal 60, by offsetting the output of U2 to be slightly positive. Using a 15 millivolt offset, the U2 output shown in FIG. 4 can be easily obtained. Steady state DC currents between $-5\times10^{-10}$ amps and greater than $+15\times10^{-10}$ amps input to U2 thus have no affect on DC output level. According to this technique, DC output stability is improved by approximately a factor of 10, and the usable dynamic range is greater than 10,000.

Figure 5:
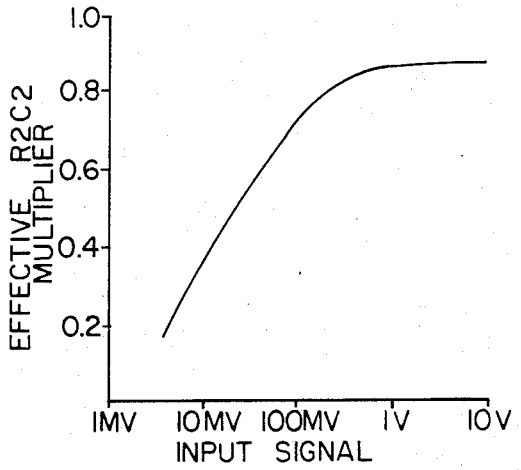
FIG. 5. illustrates graphically the dependence of the correction signal decay time constant on the input signal amplitude.

Offsetting the output of U2 by a few millivolts has the further advantage of allowing the effective value of the time constant R2C2 to be selectively dependent on signal amplitude. The power supply voltage tc the collector 32 of the electron multiplier 24 is generally filtered to reduce the AC component, including the 120 Hertz component, to less than a few millivolts. FIG. 5 illustrates graphically a desired change in the effective R2C2 time constant for different AC input signal amplitudes. For conventional detected input signals in excess of 1OOmV, the effective R2C2 time constant remains substantially unchanged. The effective R2C2 value is, however, substantially reduced for AC input signals in the 1mV to 1OmV range. Although signal loss increases for a decreasing effective R2C2 value, this signal loss is not of concern and rather is beneficial for a undesirable current signals not representative of detected ions. Small AC input signal fluctuations due, for example, to 120 Hertz ripple can thus be effectvely cancelled with only a small loss in low level signal intensity, and virtually no loss in high level signal intensity. The magnitude of this effect, and thus the range of AC currents which have no effect on the voltage output of U2, may be increased to further reduce DC current fluctuations, although the modulated output signal will then have an increased inaccuracy.

Figure 6:
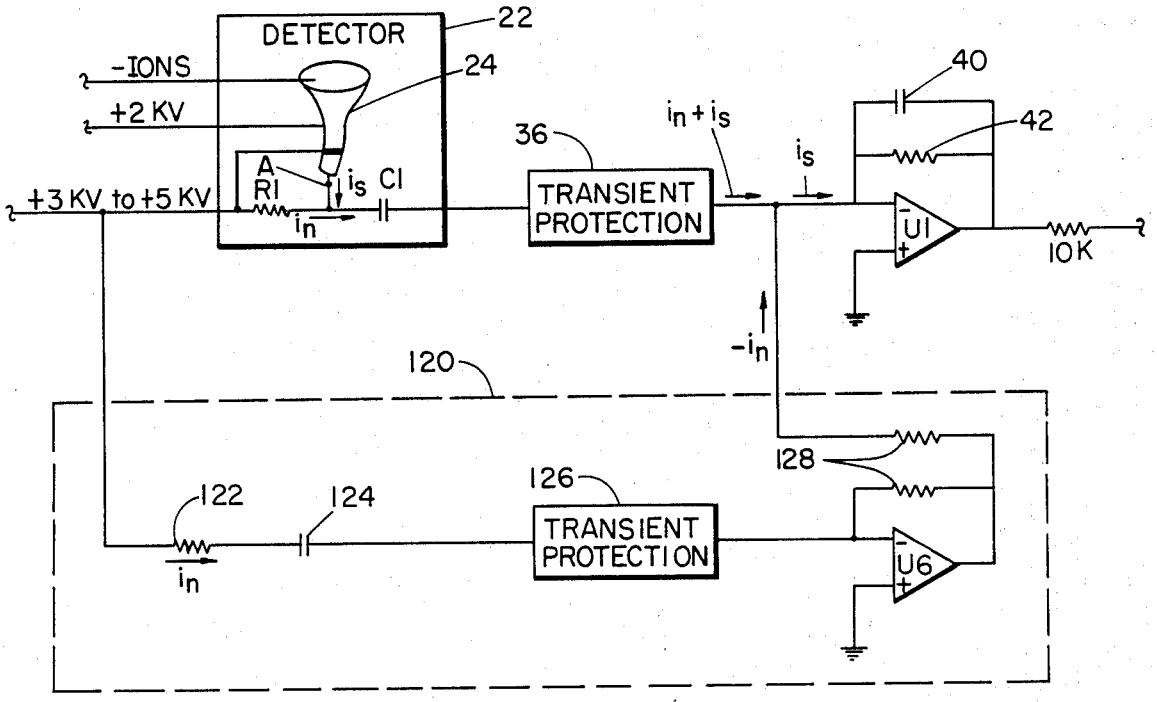
FIG. 6 is a block diagram of an alternate embodiment of a portion of the circuitry shown in FIG. 1 which may be used to cancel out noise signals on the high voltage line to the anode of the electron multiplier.

Modifications to the circuitry shown in FIG. 1 may easily be made, as shown in FIG. 6, to provide a greater degree of noise suppression on the high voltage supply output. A differential input circuit 120 as shown in FIG. 6 can thus be added to circuit shown in FIG. 1, which includes detector 24 R1, C1, transient protection 36, and U1 as previously described. Circuit 120 generates an inverted replica signal (equal amplitude and opposite polarity) of the noise current, $i_n$, flowing through R1 and C1 in the electron multiplier circuit. When this inverted signal, $-i_n$, is fed to the input of current amplifier, U1, effective ancellation of the noise current is achieved so that current amplifier, U1, sees only signal current $i_s$. For maximum efficiency of noise cancellation, the values of resistor 122 and capacitor 124 feeding U6 should be matched to R1 and C1 feeding U1. The noise current to resistor 122 will effectively be at the noise voltage to the electron multiplier circuit. Resistors 128 should be of the same value, and the values of resistor 122 and capacitor 124 preferably will approximate the value of resistor $R_1$ and capacitor $C_1$.

Beam on times $t_e$ and beam off times $t_o$ can be varied depending on the specific application and the data handling system. The minimum beat off time is usually set by the need for the current amplifier circuitry and the peak detector to establish baseline correction. Typical response time for U1 is 15 microseconds and allowing 4 time constants would give a minimum beam off time, $t_o$, of 60 microseconds. Peak detector U3 may respond in approximately 20 miscroseconds, and accordingly the speed of the current amplifier U1 is the dominant control. As previously explained, maximum beam on times $t_e$ are determined by the value of R1C1 and the desired maximum mass scanning rates. For many applications, especially for low intensity signals, the beam on time can thus be greater than five times, and often between 8 to 10 times the beam off time.

According to the present invention, the frequency of the modulation signal (determined by $t_e$ and $t_o$) can be set to match the data handling system being utilized. Many mass spectrometry systems integrate the ion beam by taking several "sample and hold" measurements at fixed intervals during each mass measurement. For example, a typical Hewlett-Packard mass spectrometry system samples every 43 microseconds, and takes either 2, 4, 8, 16, 32, etc. samples at each 0.1 amu mass step. Thus four Hewlett-Packard samples may correspond to 172 microseconds (5.8 kilohertz), while 8 samples would correspond to 344 microseconds (2.9 kilohertz). By matching the modulation frequency to the data system sampling rate, the same number of "on" and "off" cycles are necessarily integrated at each mass step. If an analog output signal is required, the maximum modu- lation frequency of approximately 10 kilohertz would be desired since the output must then be filtered.

As previously explained, mass spectrometry techniques according to the present invention are able to detect both positive and negative ions. By simply switching voltages on the electron multiplier so that the multiplier entrance may be varied from −1kV to −3kV while the anode is at ground potential, the electron multiplier can easily detect positive ions.

Figure 7:
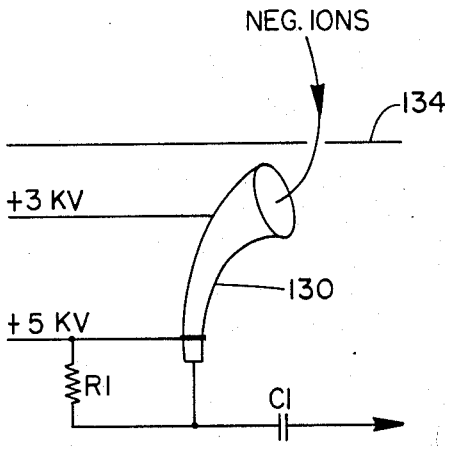
FIG. 7 is a conceptual diagram of an alternate embodiment of a negative ion detector according to the present invention suitable for high mass ion detection.
Figure 8:
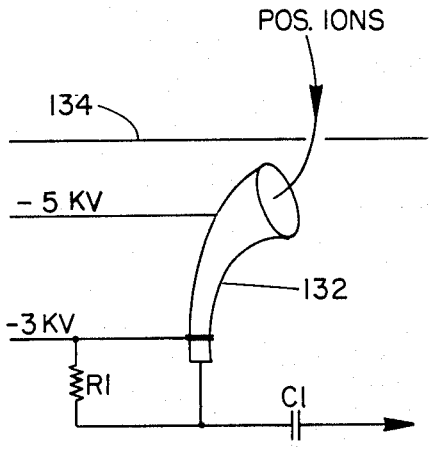
FIG. 8 is a conceptual diagram of an alternate embodiment of a positive ion detector according to the present invention suitable for high mass ion detection.

The concept of the present invention also enables the detector sensitivity to be substantially increased for detecting high mass negative or positive ions. As shown in FIG. 7, sensitivity for negative ion detection can be increased by increasing the positive potential to the cathode of the electron multiplier 130 to a high positive potential in the range of +1kV to +4kV, while maintaining the anode at a +1kV to +3kV higher positive potential (from +2kV to +7kV). Similarly, the sensitivity for detecting high mass positive ions can be increased as shown in FIG. 8 by charging the cathode at a negative potential in the range of from −1kV to −5 kV, while still maintaining the anode of the electron multiplier 132 at a high potential relative to ground, e.g., from 1kV to 3kV more positive than the cathode, but not at ground potential. The simplified dectectors shown in FIGS. 7 and 8 are provided with a conventional aperture screen 134 for receiving ions from the mass analyzer. The embodiments shown in FIGS. 7 and 8 thus act to increase the draw-in electric field at the multiplier entrance, the cathode, so that a greater percentage of ions exiting the mass analyzer 20 are drawn into the multiplier 24. According to preferred embodiments of the present invention, the potential of both the anode and the cathode of the electron multiplier is high, i.e., in excess of 1kV above or below ground potential, but preferably not substantially in excess of 5 kV above or below ground potential. The potential of the anode is, as explained, at least about 1kV more positive (less negative) than the cathode potential.

Figure 9:
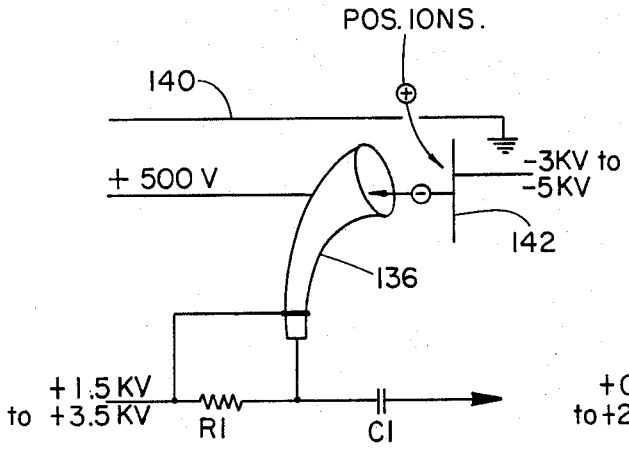
FIG. 9 is a conceptual diagram of an alternate embodiment of a positive ion detector according to the present invention utilizing a conversion dynode.
Figure 10:
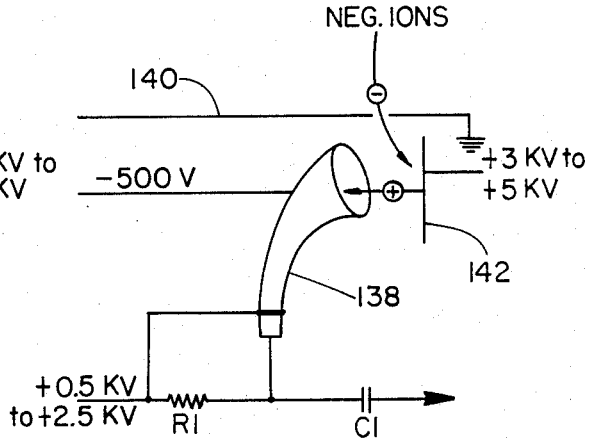
FIG. 10 is a conceptual diagram of an alternate embodiment of a negative ion detector according to the present invention utilizing a conversion dynode.

The ability of the present invention to operate the electron multiplier with the anode at a potential other than ground potential also allows for modifications of the prior art techniques utilizing an A1 or activated Be-Cu conversion dynode of the type disclosed in U.S. Pat. No 4,423,324. Ions from the mass analyzer thus pass through the grounded aperture screen 140, and are converted to oppositely charged ions by conversion dynodes 142. In the embodiment shown in FIGS. 9 and 10, the detection efficiency of multipliers 136 and 138 may be increased compared to the technique disclosed in the '324 patent by applying an appropriate selected potential to the cathode of the multiplier. Since the anode of the electron multiplier need not be operated at ground potential according to the present invention, the potential of the cathode can be chosen to optimize collection of secondary particles from the conversion dynode.

Those skilled in the art will recognize that inductive coupling rather than capacitive coupling may be used according to the techniques of this invention. For example, a high frequency ferrite core transformer with high voltage insulation could be used to inductively couple the high voltage pulsating signal from the detector to ground potential. The term "ions" as used herein means charged particles, including electrons as well as more massive particles.

Although the invention has been described in terms of the specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An improved mass spectrometry system for analyzing the composition of a sample, including an ion source and focusing means for generating an ion beam having ions representative of the sample, a mass analyzer for scanning selected ions from the beam either at a specific atomic mass unit or over a range of atomic mass units, and an ion detector having an electron multiplier with an anode and cathode for receiving ions from the beam discharged from the mass analyzer and for Providing a detector output signal indicative of the intensity of ions at a specific atomic mass unit and representative of the composition of the sample, the system further comprising:

power supply means for charging the cathode at a high negative potential to attract positive ions or at a high positive potential to attract negative ions while maintaining the anode at a positive potential relative to the cathode;

means for modulating the ion beam to the mass analyzer for producing a modulated ion beam to the detector and a modulated high-voltage output signal from the detector;

circuitry means for capacitively or inductively coupling the modulated high-voltage output signal to ground and providing a coupled output signal functionally related to the modulated high-voltage output signal;

sensing means for measuring distortion of the coupled output signal introduced by the capacitive or inductive coupling of the modulated high-voltage output signal to ground; and signal modification means for correcting the coupled output signal in response to the measured coupled output signal distortion to provide a modified coupled output signal representative of the modulated high-voltage output signal and thus the composition of the sample.

2. An improved system as defined in claim 1, wherein the cathode of the electron multiplier is charged in the range of from +1kV to +4kV while the anode of the electron multiplier is maintained in the range of from +1kV to +3kV relative to the cathode.

3. An improved system as defined in claim 1, wherein the cathode of the electron multiplier is charged in the range of from−1kV to −5kV while the anode is maintained in the range of from +1kV to +3kV relative to the cathode.

4. An improved system as defined in claim 1, wherein the sensing means generates a correction signal as a function of a peak of the coupled output signal.

5. An improved system as defined in claim 4, wherein a decay time constant of the correction signal is less than a decay time constant of the coupled output signal.

6. An improved system as defined in claim 5, wherein the decay time constant of the correction signal is substantially equal to the decay time constant of the coupled output signal.

7. An improved system as defined in claim 1, wherein the circuitry means further comprises:

a current to voltage converter for converting a current value of the coupled output signal to a voltage output indicative of the current value; and offsetting means for maintaining a constant voltage output in response to preselected low-level variations in the input current to the converter while the voltage output remains indicative of current values for coupled output signals representative of the composition of the sample.

8. An improved negative ion detector means for a scanning mass spectrometry system for analyzing the composition of a sample, the system including an ion source for producing an ion beam having ions representative of the sample, a mass analyzer for scanning selected ions from the beam over a range of atomic mass units, and power supply means for maintaining a cathode of an electron multiplier of the detector at a high positive potential and an anode of the electron multiplier at a higher positive potential for attracting negative ions, the detector means being charged by the power supply means for receiving negative ions discharged from the mass analyzer and providing a high-voltage output signal over the range of atomic mass units for analyzing the composition of the sample, the improved negative ion detector means further comprising circuitry means for capacitively or inductively coupling the high-voltage output signal to ground potential and providing a coupled output signal functionally related to the high-voltage output signal;

sensing means for measuring distortion of the coupled output signal introduced by the capacitive or inductive coupling; and correcting means for altering the coupled output signal in response to the measured coupled output signal distor- tion to provide a modified essentially ground-voltage coupled output signal representative of the high-voltage output signal.

9. An improved negative ion detector means as defined in claim 8, wherein the circuitry means capacitively couples the high-voltage output signal to ground potential.

10. An improved negative ion detector means as defined in claim 8, wherein the cathode of the electron multiplier is charged by the power supply means to the range of from +1kV to +4kV while the anode of the electron multiplier is maintained in the range of from +2kV to +5kV.

11. An improved negative ion detector means as defined in claim 8, wherein the sensing means generates a correction signal as a function of a peak of the coupled output signal.

12. An improved negative ion detector means as defined in claim 11, wherein a decay time constant of the correction signal is less than and substantially equal to a decay time constant of the coupled detector output signal.

13. In a mass spectrometry system for analyzing the composition of a sample, the system including an ion source for producing an ion beam having ions representative of the sample, a mass analyzer for scanning selected ions from the beam either at specific atomic mass unit or over a range of atomic mass units, and an ion detector having an electron multiplier with an anode and cathode for receiving ions from the beam discharged from the mass analyzer, an improved method of obtaining an output signal indicative of the intensity, of ions at a specific atomic mass unit and representative of the composition of the sample, the method comprising:

charging the cathode at a high negative potential to attract positive ions or at a high positive potential to attract negative ions while maintaining the anode at a positive potential relative to the cathode;

modulating the ion beam to the mass analyzer to produce a modulated ion beam to the detector and a modulated high-voltage output signal from the detector;

capacitively or inductively coupling the modulated high-voltage output signal to ground and providing a coupled output signal functionally related to the modulated high-voltage output signal;

measuring distortion of the coupled output signal introduced by the capacitive or inductive coupling of the modulated high-voltage output signal to ground; and correcting the coupled output signal in response to the measured coupled output signal distortion to provide an essentially ground-voltage modified coupled output signal representative of the modulated high-voltage output signal.

14. A method as defined in claim 13, wherein the cathode of the electron multiplier is charged in the range of from +1kV to +4 kV while the anode of the electron multiplier is maintained in the range of from +2kV to +5kV.

15. A method as defined in claim 13, wherein the anode of the electron multiplier is maintained in the range of from −1kV to −4kV while the cathode is charged in the range of from −2kV to −5kV.

16. A method as defined in claim 13, wherein the step of measuring distortion of the coupled output signal comprises generating a correction signal as a function of a peak of the coupled output signal.

17. A method as defined in claim 16, wherein a selected decay time constant of the correction signal is less than a selected decay time constant of the coupled output signal.

18. A method as defined in claim 17, wherein the selected decay time constant of the correction signal is substantially equal to the selected decay time constant of the coupled output signal.

19. A method as defined in claim 13, wherein the modulated high-voltage output signal is capacitively coupled to ground.

20. A method as defined in claim 13, further comprising:

converting a current value of the coupled output signal to a voltage output indicative of the current value; and maintaining a constant voltage output in response to preselected low-level variations in the current input while the voltage output remains indicative of current values for coupled output signals representative of the composition of the sample.

* * * * *